US005201680A

United States Patent [19]

Binversie et al.

[11] Patent Number: 5,201,680

[45] Date of Patent: Apr. 13, 1993

[54] MARINE PROPULSION DEVICE HAVING QUICK-DISCONNECT CONNECTOR

[75] Inventors: Gregory J. Binversie, Grayslake, Ill.; H. Norman Petersen, Kenosha, Wis.; David J. Hall, Zion, Ill.

[73] Assignee: Outboard Marine Corporation, Waukegan, Ill.

[21] Appl. No.: 762,859

[22] Filed: Sep. 18, 1991

[51] Int. Cl.[5] ..... B63H 19/00; B63H 5/20; B63H 5/12; B63H 21/26

[52] U.S. Cl. ..... 440/113; 440/53; 440/61; 440/57

[58] Field of Search ..... 440/53, 54, 113, 61, 440/62, 111, 900, 88, 65, 59, 57; 248/640, 641, 642

[56] References Cited

U.S. PATENT DOCUMENTS

| | | | |
|---|---|---|---|
| 4,157,492 | 6/1979 | Colbrese | 320/25 |
| 4,449,945 | 5/1984 | Ferguson | 440/61 |
| 4,477,801 | 10/1984 | Robinson, Jr. et al. | 340/684 |
| 4,482,330 | 11/1984 | Cook | 440/61 |
| 4,666,410 | 5/1988 | Anselm | 440/61 |
| 4,759,728 | 7/1988 | Cobb | 439/503 |
| 4,907,993 | 3/1990 | Thompson | 440/61 |

*Primary Examiner*—Joseph F. Peters, Jr.
*Assistant Examiner*—Kenneth Lee
*Attorney, Agent, or Firm*—Michael, Best & Friedrich

[57] ABSTRACT

An outboard motor comprising a propulsion unit adapted to be mounted on a boat for pivotal movement relative thereto about a generally horizontal axis, the propulsion unit including a propeller shaft, and an engine drivingly connected to the propeller shaft, and the outboard motor further comprising structure for pivoting the propulsion unit about the generally horizontal axis, the pivoting structure being adapted to be mounted outside the boat, and the pivoting structure comprising a housing having an interior and an exterior, an electric motor in the interior, and a first quick-disconnect connector portion which is electrically connected to the motor and which is accessible from the exterior of the housing for selective mating with another quick-disconnect connector portion.

20 Claims, 3 Drawing Sheets

MARINE PROPULSION DEVICE HAVING QUICK-DISCONNECT CONNECTOR

BACKGROUND OF THE INVENTION

The invention relates to electric motors in hydraulic tilt/trim assemblies in marine propulsion devices. More particularly, the invention relates to connectors for connecting an electric motor of a hydraulic tilt/trim assembly to an electric power source.

A known marine propulsion device comprises a hydraulic tilt/trim assembly having a hydraulic pump driven by an electric motor. The hydraulic assembly includes a cable which has a conductor that is fixed, with solder for example, to the electric motor of the hydraulic assembly, and which connects the motor to a power source spaced from the electric motor. In order to remove the hydraulic assembly from the rest of the marine propulsion device, for servicing for example, it is necessary to disconnect the cable from the power source, and to remove the cable from wherever it is routed between the power source and the electric motor (usually through stern brackets and motor covers), before the rest of the hydraulic assembly can be removed from the marine propulsion device. This disconnection and removal of the cable is necessary because the cable is fixed to the electric motor and removable at the power source. This disconnection and removal of the cable disadvantageously slows removal of the hydraulic assembly.

Attention is directed toward Colbrese, U.S. Pat. No. 4,157,492, issued on Jun. 5, 1979; Robinson, Jr. et al. U.S. Pat. No. 4,477,801, issued on Oct. 16, 1984; Cobb, U.S. Pat. No. 4,759,728, issued on Jul. 26, 1988; and U.S. patent application Ser. No. 07/523,329 assigned to the assignee of the present invention.

SUMMARY OF THE INVENTION

The invention provides an outboard motor comprising a propulsion unit adapted to be mounted on a boat for pivotal movement relative thereto about a generally horizontal axis, the propulsion unit including a propeller shaft, and an engine drivingly connected to the propeller shaft, and the outboard motor further comprising means for pivoting the propulsion unit about the generally horizontal axis, the pivoting means being adapted to be mounted outside the boat, and the pivoting means comprising a housing having an interior and an exterior, an electric motor in the interior, and a first quick-disconnect connector portion which is electrically connected to the motor and which is accessible from the exterior of the housing for selective mating with another quick-disconnect connector portion.

One embodiment of the invention provides a hydraulic assembly adapted to be mounted on the outside of a boat for pivoting a marine propulsion unit relative to the boat, the hydraulic assembly comprising a housing having an interior and an exterior, electrically operable means in the interior, and a first quick-disconnect connector portion which is electrically connected to the electrically operable means and which is accessible from the exterior of the housing for selective mating with another quick-disconnect connector portion.

One embodiment of the invention provides an outboard motor comprising a propulsion unit adapted to be mounted on a boat for pivotal movement relative thereto about a generally horizontal axis, the propulsion unit including a propeller shaft, and an engine drivingly connected to the propeller shaft, and the outboard motor further comprising means for pivoting the propulsion unit about the generally horizontal axis, the pivoting means being adapted to be mounted outside the boat, and the pivoting means comprising a hydraulic assembly including a housing having an interior and an exterior, having an electric motor in the interior, and having a male connector portion which is electrically connected to the motor and which is accessible from the exterior of the housing, and the hydraulic assembly further comprising a hydraulic pump connected to the motor, and a hydraulic cylinder/piston assembly in fluid communication with the pump, and the pivoting means further comprising a female connector portion releaseably mated with the male portion and adapted to be electrically connected to a power source.

A feature of the invention is the provision of an outboard motor tilt/trim assembly including a quick-disconnect connector as described above. This facilitates maintenance of a hydraulic assembly of a marine propulsion device.

Other features and advantages of the invention will become apparent to those of ordinary skill in the art upon review of the following detailed description, claims, and drawings.

Figure 1:
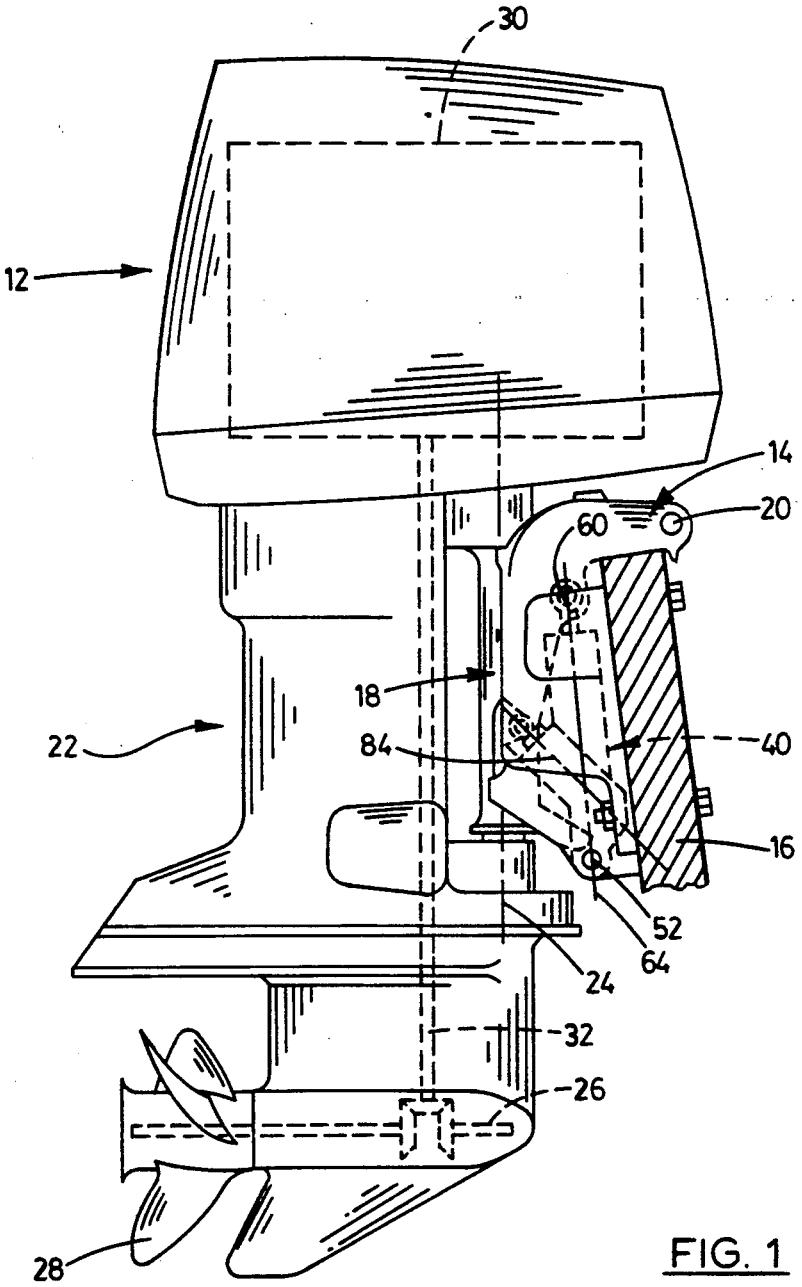
FIG. 1 is a starboard side elevational view of a marine propulsion device which embodies various of the features of the invention and which includes a hydraulic tilt/trim assembly comprising an electric motor, a hydraulic pump driven by the electric motor, a cylinder/piston assembly in fluid communication with the hydraulic pump, a first electrical connector portion electrically connected to the electric motor, and a second electrical connector portion mated with the first electrical connector portion.

Before one embodiment of the invention is explained in detail, it is to be understood that the invention is not limited in its application to the details of construction and the arrangement of components set forth in the following description or illustrated in the drawings. The invention is capable of other embodiments and of being practiced or carried out in various ways. Also, it is to be understood that the phraseology and terminology used herein is for the purpose of description and should not be regarded as limiting.

DETAILED DESCRIPTION OF THE PREFERRED EMBODIMENT OF THE INVENTION

A marine propulsion device 12 embodying the invention is illustrated in the drawings. While the illustrated marine propulsion device is an outboard motor, the invention is also applicable to other types of marine propulsion devices such as stern drive units.

The marine propulsion device 12 comprises a transom bracket 14 fixedly mounted to a transom 16 of a boat, and a swivel bracket 18 pivotally mounted on the transom bracket 14 for pivotal movement relative thereto about a generally horizontally extending tilt axis 20.

The marine propulsion device 12 also includes a propulsion unit 22 connected to the swivel bracket 18 for common movement therewith about the tilt axis 20 and for pivotal movement relative to the swivel bracket 18 about a generally vertical steering axis 24. The propulsion unit 22 comprises a propeller shaft 26 supporting a propeller 28, and an engine 30 drivingly connected to the propeller shaft by a conventional drive train 32.

Figure 2:
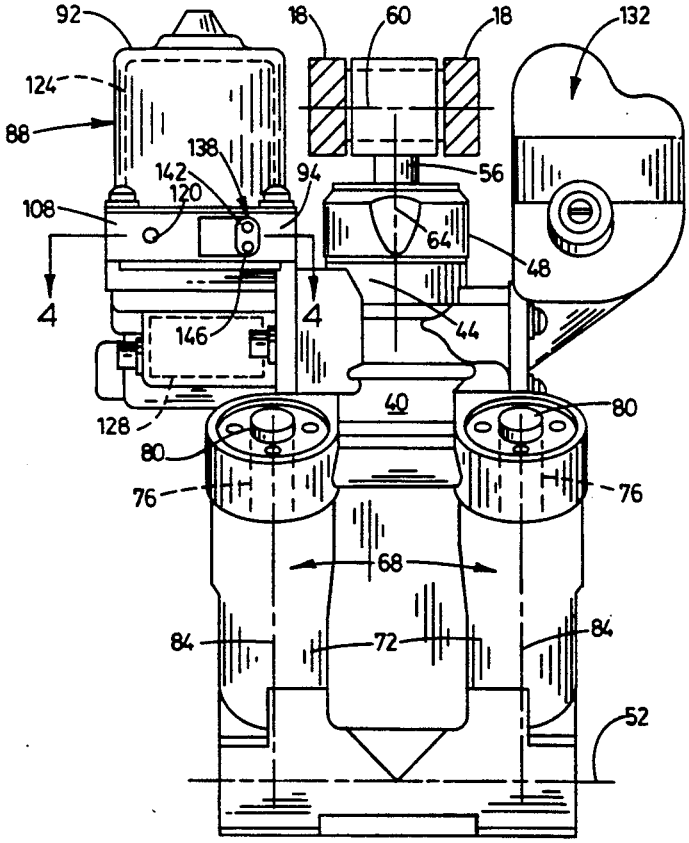
FIG. 2 is an enlarged fragmentary view showing the hydraulic tilt/trim assembly with one of the connector portions removed.

The marine propulsion device 12 further includes means for pivoting the propulsion unit about the tilt axis 20. While various other means could be employed, in the illustrated embodiment, the pivoting means includes a power source 36 illustrated schematically in FIG. 3. In the illustrated embodiment, the power source 36 comprises a battery and/or an alternator. The pivoting means further comprises (see FIGS. 1-3) a hydraulic trim and tilt assembly 40 for selectively pivoting the swivel bracket 18 and the connected propulsion unit 22 about the horizontal tilt axis 20 and relative to the transom bracket 14. The hydraulic trim and tilt assembly 40 includes a hydraulic tilt cylinder/piston assembly 44 comprising a tilt cylinder 48 having a lower blind end pivotally connected to the transom bracket 14 about a first or lower horizontal axis 52, and a tilt piston rod 56 which extends from the other end of the tilt cylinder 48 and which, at the outer end thereof, is pivotally connected to the swivel bracket 18 about a second or upper horizontal axis 60. The tilt cylinder/piston assembly 44 defines an axis 64 which extends generally vertically at all times throughout tilting movement of the swivel bracket 18 and the connected propulsion unit 22.

The hydraulic tilt and trim assembly 40 also includes (see FIG. 2) a pair of laterally aligned hydraulic trim cylinder/piston assemblies 68 which are respectively fixed to the tilt cylinder 48 on opposite sides thereof and which include respective trim cylinders 72 having blind or closed lower ends and open rearward and upper outer ends. Extending from the trim cylinders 72 are respective trim piston rods 76 having outer ends 80 which engage the swivel bracket 18. The trim cylinder/piston assemblies 68 define respective axes 84 extending upwardly and rearwardly at an angle of about 30° to the axis 64 of the tilt cylinder/piston assembly 44. Because the trim cylinders 72 are fixed to the tilt, the trim cylinder/piston assemblies 68 are pivotal about the lower horizontal axis 52 in common with the tilt cylinder 48. Unlike the tilt piston rod 56, the outer ends 80 of the trim piston rods 76 are free of fixed connection with the swivel bracket 18.

The hydraulic tilt and trim assembly 40 also includes (see FIGS. 2-4) a reversible electric motor and pump sub-assembly 88 which comprises a housing 92 fixedly connected to the tilt cylinder 48. The housing 92 comprises a plastic base 94, an interior 96 and an exterior 100. The exterior 100 of the housing 92 has a surface 104 facing toward the boat, and a surface 108 facing away from the boat. The surface 108 has therein (see FIG. 4) a generally L-shaped recess 112, and has therein a threaded bore 120 spaced from the recess 112.

The reversible electric motor and pump sub-assembly 88 further includes electrically operable means in the housing 92. More particularly, in the illustrated embodiment, the reversible electric motor and pump sub-assembly 88 includes (see FIGS. 2 and 3) a reversible electric motor 124 in the housing 92. The reversible electric motor and pump sub-assembly 88 further includes (see FIG. 2) a hydraulic pump 128 also located in the housing 92 and drivingly engaged by the electric motor 124. The hydraulic pump 128 is hydraulically connected with a sump or reservoir subassembly 132 which is also fixedly connected to the tilt cylinder 48. The hydraulic pump 128 is also hydraulically connected with the tilt and trim cylinders 48 and 72 and, when driven by the electric motor 124, supplies hydraulic fluid to the tilt and trim cylinders 48 and 72 to effect movement of the tilt and trim piston rods 56 and 76.

The reversible electric motor and pump sub-assembly 88 further includes (see FIGS. 2 and 4) a male quick-disconnect connector portion 138 which is accessible from the exterior 100 of the housing for selective mating with another quick-disconnect connector portion. The male connector portion 138 comprises a pair of brass probes 142 and 146, respectively, located in the recess 112 and arranged for selective mating with a female quick-disconnect connector portion. In the illustrated embodiment, the probes 142 and 146 are fixed to the housing 92 with epoxy. The brass probe 146 is electrically connected to the motor 124, through the housing 92, by a conductor 147, and by solder wire 148 that is connected between the conductor 147 and the probe 146. The probe 142 is electrically connected to the motor 124 in the same manner.

Figure 4:
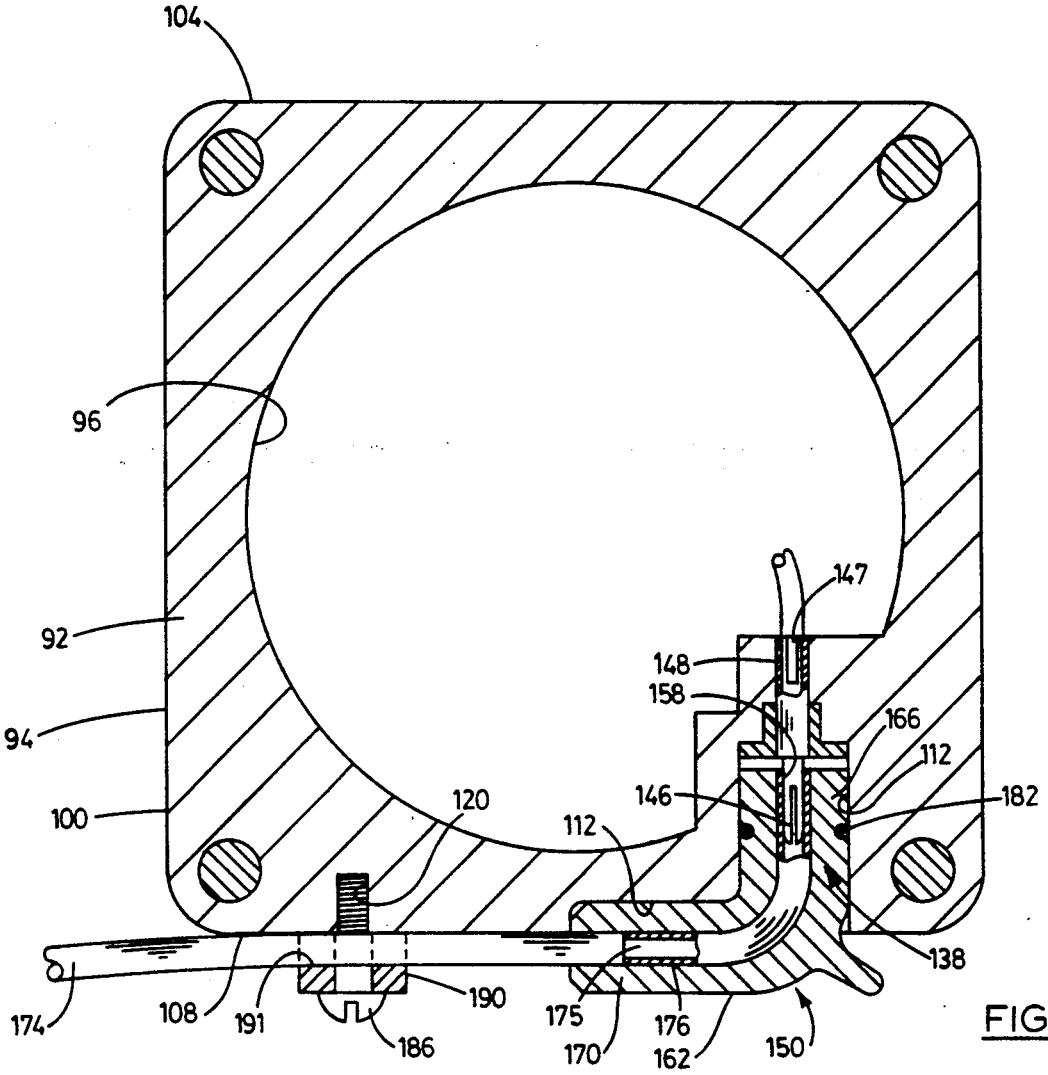
FIG. 4 is a sectional view taken along line 4—4 of FIG. 2.
Figure 5:
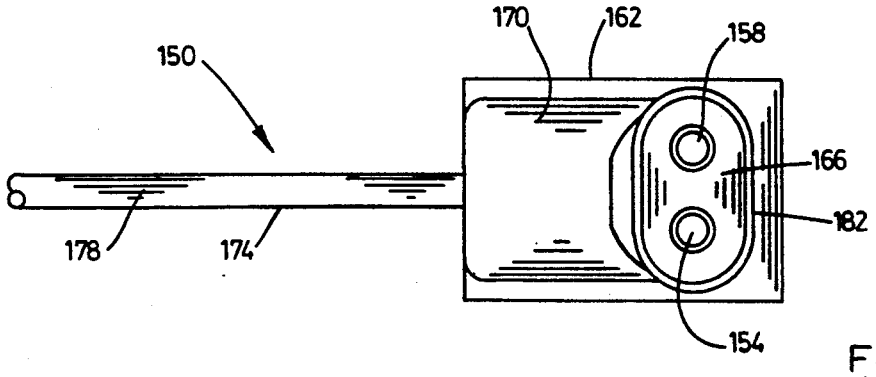
FIG. 5 is a view of one of the connector portions disconnected from the electric motor and rotated 90° from its orientation shown in FIG. 3.

The hydraulic tilt and trim assembly 40 further includes (see FIGS. 3-5) a female quick-disconnect connector portion 150 that is selectively mateable with the male connector portion 138 and that is electrically connected to the power source 36. The female connector portion 150 comprises a pair of electrically conductive sockets 154 and 158 respectively engageable with the probes 142 and 146. The female connector portion 150 further comprises a generally L-shaped, generally non-conductive casing 162 having a first leg 166, and a second leg 170 extending transversely from the first leg 166. The sockets 154 and 158 are fixed in the first leg 166 of the casing 162. The L-shaped casing 162 of the female connector portion 150 mates with the L-shaped recess 112 in the housing 92 when the male connector portion 138 mates with the female connector portion 150. In other words, the recess 112 and the female connector portion 150 are correspondingly L-shaped.

Figure 3:
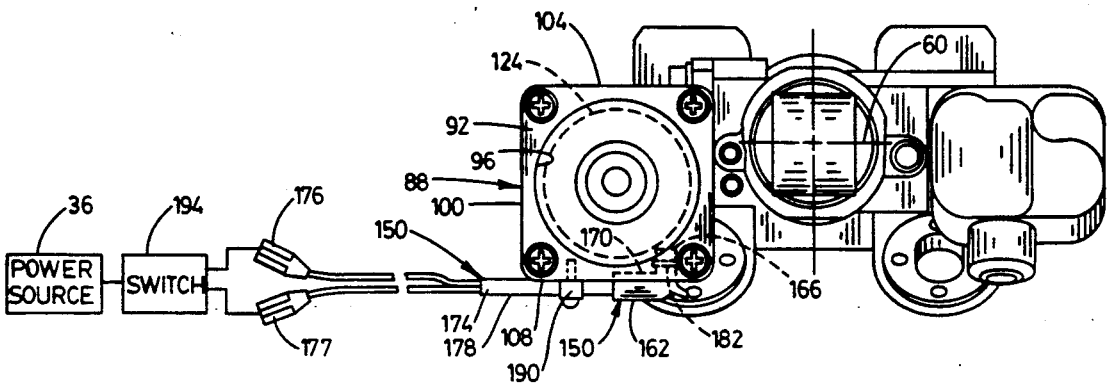
FIG. 3 is a top plan view showing a portion of the hydraulic tilt/trim assembly that includes the electric motor.

The female connector portion 150 further comprises (see FIGS. 3 and 4) a cable 174 extending from the second leg 170 of the casing 162. The cable 174 includes (see FIG. 4) a conductor 175 which is electrically connected, with solder wire 176, to the socket 158, and which terminates in a female lug connector 176 (FIG. 3). The cable 174 further includes a second conductor (not shown) which is electrically connected, with solder wire (not shown) to the socket 154, and which terminates in a female lug connector 177. The cable 174 further includes insulation 178 surrounding the conductors.

In the illustrated embodiment, the casing 162 is molded of Hytrel, and the sockets 154 and 158 and conductors are inserted into the casing 162 while the casing 162 is being molded. Also, while the casing 162 is molded, an enlarged circumference portion or O-ring 182 (see FIGS. 3 and 4) is defined in the first leg 166.

The hydraulic tilt and trim assembly 40 further comprises means for securing the cable 174 to the housing 92, at a location spaced from the casing 162. While other means could be employed, in the illustrated embodiment, such means comprises (see FIG. 4) a threaded screw 186 selectively threadable with the threaded bore 120 in the housing 92, and a clip 190 which is securable to the housing 92 by the threaded screw and which includes an inner semi-cylindrical surface 191 engaging the cable 174 and securing the cable 174 to the housing 92 when the clip 190 is secured to the housing 92. Alternatively, instead of using a clip, the cable 174 could have an aperture (not shown) through the insulation 178, which aperture is spaced from the previously described conductors, spaced from the sockets 154 and 158, and aligned with the threaded bore 120 when the male connector portion 138 is mated with the female connector portion 150 and when there is no slack in the cable 174 between the sockets 154 and 158 and the aperture through the insulation 178.

Any suitable means can be employed to actuate the reversible electric motor and pump sub-assembly 88. For example, in the disclosed construction, such means comprises (see FIG. 3) a two-button switch 194 connected between the power source 36 and the cable 174.

Various of the features of the invention are set forth in the following claims.

We claim:

1. An outboard motor comprising a propulsion unit adapted to be mounted on a boat for pivotal movement relative thereto about a generally horizontal axis, said propulsion unit including a propeller shaft, and an engine drivingly connected to said propeller shaft, and said outboard motor further comprising means for pivoting said propulsion unit about the generally horizontal axis, said pivoting means being adapted to be mounted outside the boat, and said pivoting means comprising a housing having an interior and an exterior, an electric motor in said interior, and a first quick-disconnect connector portion which is electrically connected to said motor, which is fixed to said housing, and which is accessible from said exterior of said housing for selective mating with another quick-disconnect connector portion.

2. An outboard motor in accordance with claim 1 wherein said pivoting means further comprises a hydraulic cylinder/piston assembly, and a hydraulic pump that is in fluid communication with said hydraulic cylinder/piston assembly and that is driven by said electric motor.

3. An outboard motor in accordance with claim 1 wherein said pivoting means comprises a power source, and a second quick-disconnect connector portion that is selectively mateable with said first connector portion and that is electrically connected to said power source.

4. An outboard motor in accordance with claim 3 wherein said first connector portion comprises an electrically conductive probe, and wherein said second connector portion comprises an electrically conductive socket engageable with said probe.

5. An outboard motor comprising a propulsion unit adapted to be mounted on a boat for pivotal movement relative thereto about a generally horizontal axis, said propulsion unit including a propeller shaft, and an engine drivingly connected to said propeller shaft, and said outboard motor further comprising means for pivoting said propulsion unit about the generally horizontal axis, said pivoting means being adapted to be mounted outside the boat, and said pivoting means including a housing having an interior and an exterior, an electric motor in said interior, a first quick-disconnect connector portion which is electrically connected to said motor, and which comprises an electrically conductive probe accessible from said exterior of said housing, said pivoting means further including a power source, and a second quick-disconnect connector portion that is electrically connected to said power source, that comprises an electrically conductive socket selectively engageable with said probe, and that further comprises a generally L-shaped, generally non-conductive casing having a first leg, and a second leg extending transversely from said first leg, said socket being fixed in said first leg of said casing.

6. An outboard motor in accordance with claim 5 wherein said exterior of said housing has therein a generally L-shaped recess corresponding in shape to said casing of said second connector portion, and wherein said probe is located in said recess such that said casing of said L-shaped second connector portion mates with said L-shaped recess in said housing when said first connector portion mates with said second connector portion.

7. An outboard motor in accordance with claim 5 wherein said second connector portion further comprises a cable extending from said second leg of said casing, said cable including a conductor electrically connected to said socket, and insulation surrounding said conductor, and wherein said hydraulic assembly comprises means for securing said cable to said housing, at a location spaced from said casing.

8. An outboard motor in accordance with claim 1 wherein said exterior of said housing has a surface facing toward the boat, and a surface facing away from the boat, and wherein said first quick-disconnect portion is accessible from said surface facing away from the boat.

9. A hydraulic assembly adapted to be mounted on the outside of a boat for pivoting a marine propulsion unit relative to the boat, said hydraulic assembly comprising a housing having an interior and an exterior, an electric motor in said interior, and a first quick-disconnect connector portion which is electrically connected to said electric motor, which is fixed to said housing, and which is accessible from said exterior of said housing for selective mating with another quick-disconnect connector portion.

10. A hydraulic assembly in accordance with claim 9 and further comprising a second quick-disconnect connector portion that is selectively mateable with said first connector portion and that is adapted to be electrically connected to a power source.

11. A hydraulic assembly in accordance with claim 10 wherein said first connector portion comprises an electrically conductive probe, and wherein said second connector portion comprises an electrically conductive socket engageable with said probe.

12. A hydraulic assembly in accordance with claim 11 wherein said first connector portion comprises two electrically conductive probes, and wherein said second connector portion comprises two electrically conductive sockets.

13. A hydraulic assembly adapted to be mounted on the outside of a boat for pivoting a marine propulsion unit relative to the boat, said hydraulic assembly comprising a housing having an interior and an exterior, electrically operable means in said interior, a first quick-disconnect connector portion which is electrically connected to said electrically operable means and which includes an electrically conductive probe accessible from said exterior of said housing, and said hydraulic assembly further comprising a second quick-disconnect connector portion that is adapted to be electrically connected to a power source, that includes an electrically conductive socket that is selectively mateable with said probe, and that further includes a generally L-shaped, generally non-conductive casing having a first leg, and a second leg extending transversely from said first leg, said socket being fixed in said first leg of said casing.

14. A hydraulic assembly in accordance with claim 13 wherein said second connector portion further comprises a cable extending from said second leg of said casing, said cable including a conductor electrically connected to said socket, and insulation surrounding said conductor, and wherein said hydraulic assembly further comprises means for securing said cable to said housing at a location spaced from said casing.

15. An outboard motor comprising a propulsion unit adapted to be mounted on a boat for pivotal movement relative thereto about a generally horizontal axis, said propulsion unit including a propeller shaft, and an engine drivingly connected to said propeller shaft, and said outboard motor further comprising means for pivoting said propulsion unit about the generally horizontal axis, said pivoting means being adapted to be mounted outside the boat, and said pivoting means comprising a hydraulic assembly including a housing having an interior and an exterior, having an electric motor in said interior, and having a male connector portion which is electrically connected to said motor and which is accessible from said exterior of said housing, and said hydraulic assembly further comprising a hydraulic pump connected to said motor, and a hydraulic cylinder/piston assembly in fluid communication with said pump, and said pivoting means further comprising a female connector portion releaseably mated with said male portion and adapted to be electrically connected to a power source.

16. An outboard motor in accordance with claim 15 wherein said exterior of said housing of said hydraulic assembly has a surface facing toward the boat, and a surface facing away from the boat, and wherein said male portion is accessible from said surface facing away from the boat.

17. An outboard motor in accordance with claim 15 wherein said male connector portion comprises an electrically conductive probe, and wherein said female connector portion comprises an electrically conductive socket engageable with said probe.

18. An outboard motor in accordance with claim 17 wherein said male connector portion comprises two electrically conductive probes, and wherein said female connector portion comprises two electrically conductive sockets.

19. An outboard motor in accordance with claim 17 wherein said second connector portion further comprises a generally L-shaped, generally non-conductive casing, having a first leg, and a second leg extending transversely from said first leg, and wherein said socket is fixed in said first leg of said casing.

20. An outboard motor in accordance with claim 19 wherein said female connector portion further comprises a cable extending from said second leg of said casing, said cable including a conductor electrically connected to said socket, and insulation surrounding said conductor, and wherein said hydraulic assembly further comprises means for securing said cable to said housing at a location spaced from said casing.

* * * * *